US006733239B2

(12) United States Patent
Lee

(10) Patent No.: US 6,733,239 B2
(45) Date of Patent: May 11, 2004

(54) FAN BLADE WITH AN ACTIVE CARBON FILTER BED

(76) Inventor: Tai-Ching Lee, No. 182, Sec. 2 Yung Fu Rd., Tainan (TW)

( * ) Notice: Subject to any disclaimer, the term of this patent is extended or adjusted under 35 U.S.C. 154(b) by 54 days.

(21) Appl. No.: 10/183,694

(22) Filed: Jun. 28, 2002

(65) Prior Publication Data

US 2004/0001755 A1 Jan. 1, 2004

(51) Int. Cl.[7] ..... F04D 29/70
(52) U.S. Cl. ..... 416/62; 416/91; 416/224
(58) Field of Search ..... 416/62, 146 R, 416/91, 231 B, 224, 5

(56) References Cited

U.S. PATENT DOCUMENTS 3,871,849 A * 3/1975 Smith et al. ..... 55/484
4,422,824 A * 12/1983 Eisenhardt, Jr. ..... 416/5
5,341,565 A * 8/1994 Kuryliw ..... 29/889.721
5,370,721 A * 12/1994 Carnahan ..... 96/124
5,562,412 A * 10/1996 Antonelli ..... 416/62
5,775,876 A * 7/1998 Walker et al. ..... 416/62
5,795,131 A * 8/1998 Crowhurst et al. ..... 416/146 R

* cited by examiner

*Primary Examiner*—Edward K. Look
*Assistant Examiner*—Dwayne J. White
(74) *Attorney, Agent, or Firm*—Rosenberg, Klein & Lee

(57) ABSTRACT

A fan blade provided with an active carbon filter bed, wherein, an opening is provided in the center of the fan blade, and said opening is covered with an active carbon filter bed. And said active carbon filter bed can be in the form of powder, grain or fiber attached by any means to non-woven fabric, fiber layer, staple on the base filter element of porous PE or PU foam. Furthermore, both of the active carbon filter bed and the fan blade can be adhered to each other by glue, adhesive band, equi-directional magnet or other adhesion or structure.

8 Claims, 6 Drawing Sheets

FAN BLADE WITH AN ACTIVE CARBON FILTER BED

BACKGROUND OF THE INVENTION

1. Field of the Invention

The present invention relates to a fan blade with an active carbon filter bed, and more particularly to a fan blade provided an opening covered by an active carbon filter bed which is integrated with porous active carbon or a base filter element attached with active carbon, and an adhesion bed is provided on the back of the active carbon filter bed.

2. Description of the Prior Art

Electric fan for cheaper in price and less power consumption is still welcome by the consumers. In the past, an electric fan did not provide functions of filtering and air cleaning effects. A ceiling fan recently available in the market is essentially comprised of locking frame, filter gauze and blades, within, the locking frame, provided with an inner trunk, is connected to the blade so that the blade is relatively provided over the trunk while a filter gauze is attached to the bottom of the trunk and a multiple air vents are provided through the peripherals on the trunk corresponding to the locking frame. By said configuration, the rotating blade is filtering particles in the air; however, for a ceiling fan, the air is forced by the blades downwards to create convection of air and a disturbance is created in the circumference below the ceiling fan. Since the volume of the air flowing back to where above the ceiling fan is extremely low, the air filtering effect is very poor. Besides, the filter gauze could at its best filter the larger dust particles, it can not purify the air by filtering or inhibiting those toxic substances, bacteria or virus found in the air that are detrimental to one's health.

Furthermore, another type of the prior art of the present invention is an exhaust with a filter that provide in front of the motor and facing the room. Aid filter is comprised of an external frame, and a filter sheet integrated with the frame to its inner side. While the fan rotates and draws the air into it, the dust in the air is filtered through the sheet. However, said configuration will affect the air exhaust effect and fail to filter bacteria or virus in the air.

There are inventions to combine the filter with the outside of the fan, such as U.S. Pat. Nos. 4,477,262, 4,781,525, 6,045,329, 6,254,726, 6,368,393. These designs are securing filter outside the fan, generally, it is either in front of, at the rear of, or at either side of the fan cover, when wind blown from the fan, it flows through or sucks through the filter to filter dust. The shortcoming of these designs is that the volume of wind will drop, therefore, filter is made real thin and it can only filter large particles. There is another design which has installed the filter directly onto the fan blades, such as U.S. Pat. Nos. 4,753,573 4,889,543, 5,562,412, 5,775,876, wherein both the U.S. Pat. Nos. 4,753,573 and 5,562,412 disclose a filter hanging on sealed fan blades, while U.S. Pat. No. 4,889,543, discloses filters secured between adjacent fan blades, and U.S. Pat. No. 5,562,412 discloses a frame being formed on the fan blades to accept the filter therein, both of these designs are for ceiling fans, the wind is mild, there are shortcomings that filter effect is not so good. Some ceiling fans have also formed with the filter in a hole of the fan blade, such as U.S. Pat. No. 5,341,565, and U.S. Pat. No. 5,795,131, wherein the U.S. Pat. No. 5,341,565 is to pre-formed a cavity on a fan blade, with a smaller diameter at one (lower) side of the cavity and a larger diameter at the opposite (upper) side, with grilled thereon to prevent filter from falling, however, this design is on a ceiling fan, which can not spin in a fast speed due to the eccentric principle, and therefore, the filter will not be fallen. The U.S. Pat. No. 5,795,131 is to form a groove on the blade for filter to seat therein and with grilled to prevent filter from falling. All these design are too complicated, and are designed simply for use on a ceiling fan, should the design is used on a regular fan, the eccentric force is so big that the filter can hardly be held firmly at position.

Both of the filter gauze and the filter sheet are of filters with mesh which could only filter dust of larger grain size and can not filter or inhibit toxic substances, bacteria or virus that are detrimental to one's health. Active carbon fiber though presents an ideal solution, the current technology of the trade fails to come up with a fan blade that is made of active carbon fiber and can be directly assembled into an axis of a motor to the fan; because the active carbon fiber is not of a tight construction and it could easily dispense once the blade rotates.

Whereas the front surface of the blade is used to blow the air while the air is drawn behind the blade, an active carbon filter bed can be directly attached to the fan blade without compromising the air blow sufficiency of the fan.

In addition, the structure of the general active carbon filter bed is limited only to a whole piece of non-woven fabric or a sheet fiber bed. There is the absence for further exploration into other feasible embodiments of the active carbon filter. The application of the active carbon filter is very limited in terms of industrial use.

Furthermore, though the active carbon can be used for air cleaning purpose, it is available only in the form of powder, grain, staple or porosity bed of active carbon directly carbonized from a whole sheet of woven or non-woven fabric. Within, with the exception of the porosity bed, the other three types are very difficult to be stabilized in a particular form, and the porosity bed could become very crisp and break down. Should any form of the active carbon be used in direct exposure to the air, the carbon powder or grain could fill the room to pollute the interior environment.

Finally, how to fix the active carbon filter bed onto the blade is also considered.

SUMMARY OF THE INVENTION

The primary objective of the present invention is to provide a fan blade having an opening covered with an active carbon filter bed which is integrated with porous active carbon or base filter element attached with active carbon, and an adhesion bed is provided on the back of the active carbon filter bed. And said active carbon filter bed can be in the form of powder, grain or fiber attached by any means to non-woven fabric, fiber layer, staple on the base filter element of porous PE or PU foam. Furthermore, both of the active carbon filter bed and the fan blade can be adhered to each other by glue, adhesive band, equi-directional magnet or other adhesion or structure so that once the fan blade rotates, the attached active carbon filter bed cleans the air at the same time without affecting the overall efficiency of air blow.

DETAILED DESCRIPTION OF THE PREFERRED EMBODIMENTS

Figure 1:
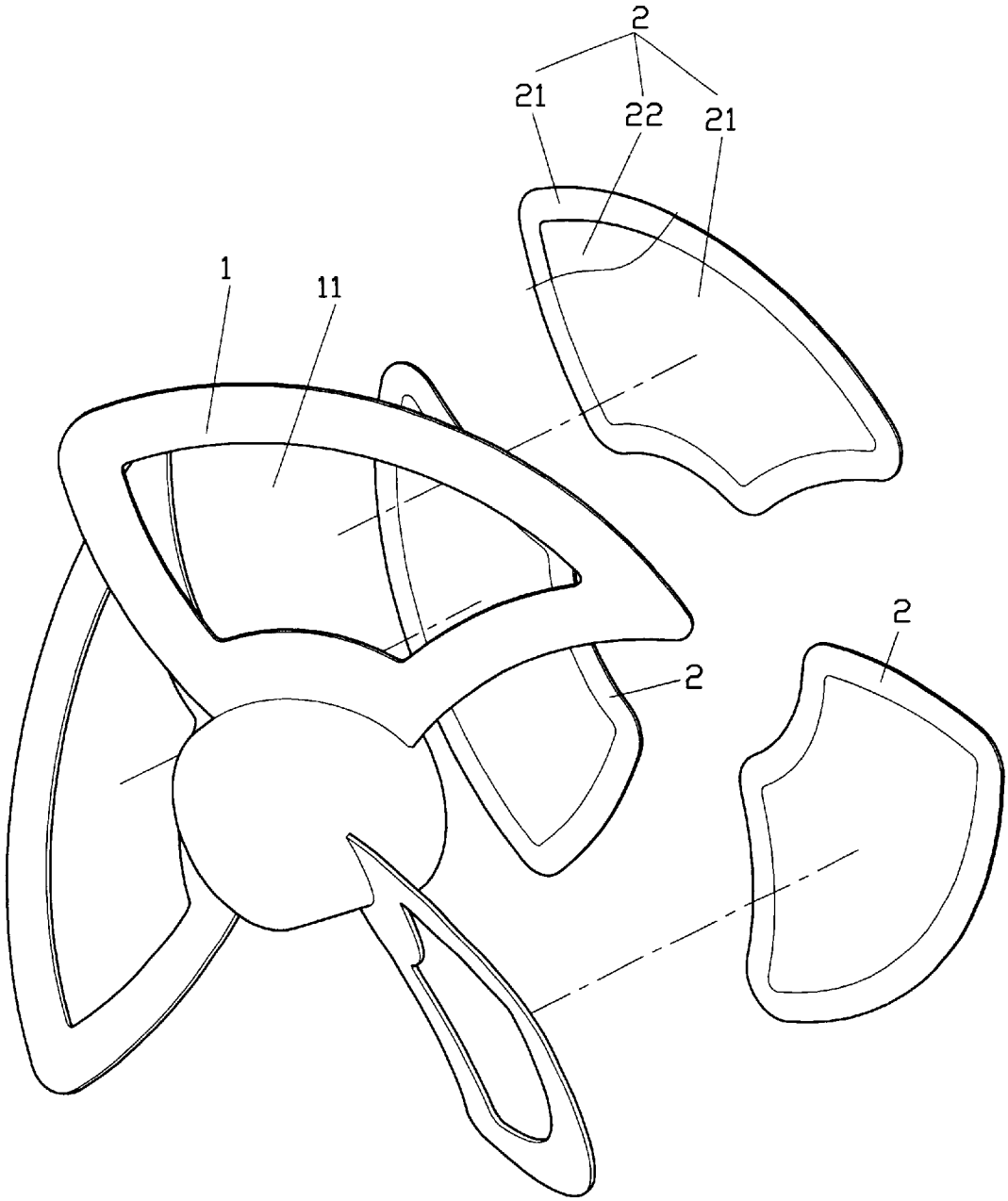
FIG. 1 is an exploded view of the first preferred embodiment of the present invention.

Referring to FIG. 1, the first preferred embodiment of the present invention is essentially comprised of a fan blade 1 and an active carbon filter bed 2. The fan blade 1 provides an opening 11 at its center. The active carbon filter bed 2 is formed by an active carbon bed 22 sandwiched by two non-woven active carbon filter beds 21. The size of the active carbon filter bed 2 is slightly larger than that of the opening 11 of the fan blade 1.

Figure 2:
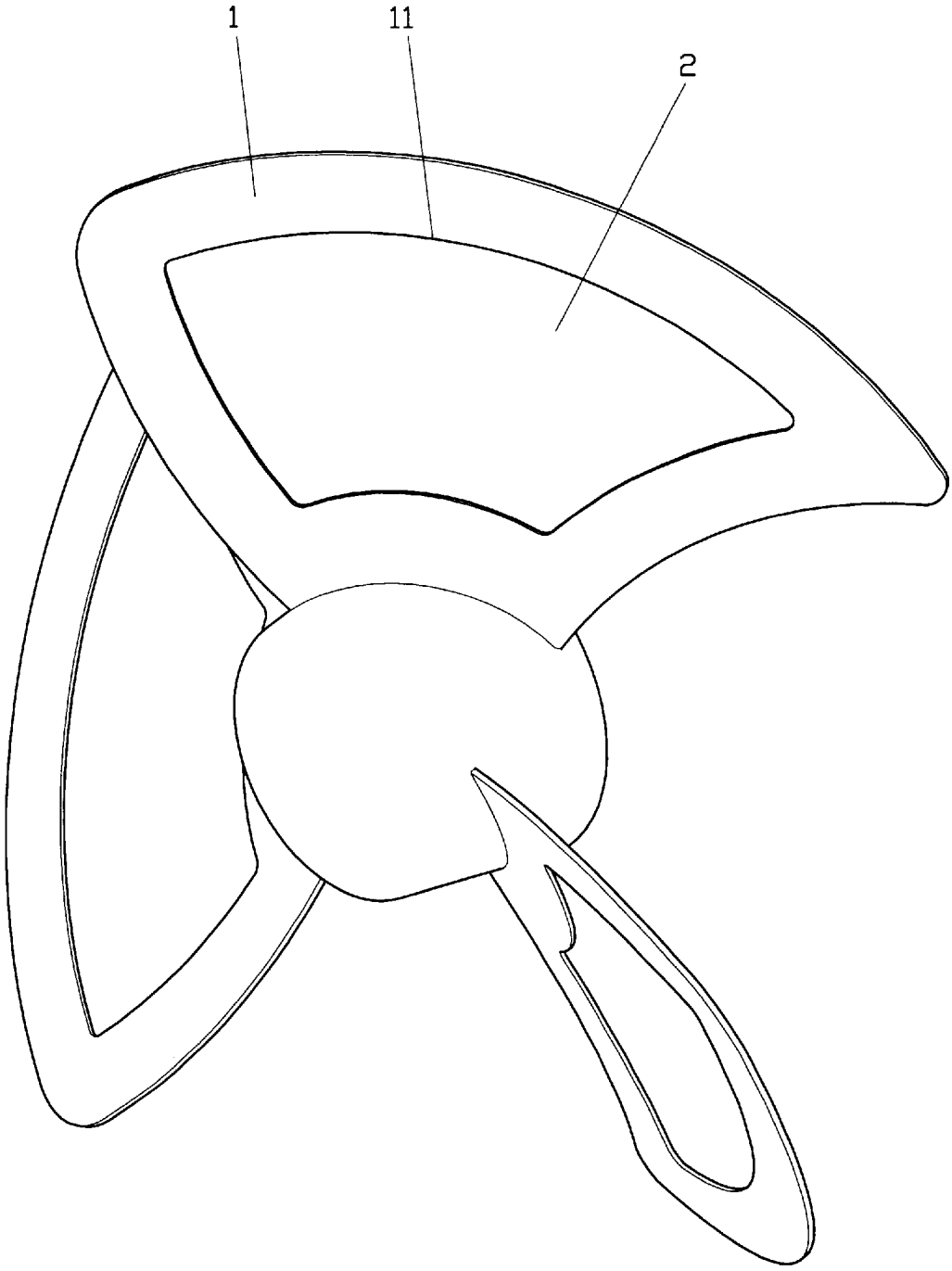
FIG. 2 is a perspective view of the first preferred embodiment of the present invention as assembled.

As shown in FIG. 2, the active carbon filter bed 2 of the first preferred embodiment is adhered to the rear side of the fan blade 1 so that the active carbon filter bed 2 fully covers up the opening II of the fan blade 1. Whereas the fan is connected to an axial of a motor which directly drives the fan blade 1 to rotate, and the air is blown from the front side of the fan blade 1 to create a transient negative pressure which draws the air from the rear side of the fan blade 1 through the active carbon filter bed 2 and the front side of the fan blade 1. As a result, those fan blades 1 filter dust and toxic particles suspended in the air or inhibiting the number of bacteria and virus by means of the active carbon bed 22 of the active carbon filter bed 2 in order to clean the air in the room. While cleaning the ambient air, the overall air blow function of said fan blade 1 adhered with the active carbon filter bed 2 will not be affected.

Now referring to those measurements made by the inventor on air velocity and volume of various types of fan blade are tabulated below:

| | Measurements of Air Velocity & Air Volume (12"-fan) (Refer to FIG. 3) | | | | | | | | | | |
|---|---|---|---|---|---|---|---|---|---|---|---|
| Type | Measure Point | | 1 | 2 | 3 | 4 | 5 | 6 | 7 | 8 | 9 |
| With Opening (11) | Air Velocity (M/min) | LH | 158 | 200 | 194 | 188 | 82 | 22 | 2 | 0 | 0 |
| | | RH | 152 | 120 | 150 | 206 | 220 | 192 | 120 | 70 | 42 |
| | | Mean | 155 | 160 | 172 | 197 | 151 | 107 | 61 | 35 | 21 |
| | Air volume Mean ($M^3$/min) | | 1.22 | 3.78 | 6.76 | 10.84 | 10.68 | 9.24 | 6.22 | 4.13 | 2.81 |
| | Motor: 110 V, 50.0 W, 1450 rpm | | | | | | | Total Air Volume | | 55.67 | |
| Without Opening | Air Velocity (M/min) | LH | 144 | 204 | 242 | 198 | 138 | 80 | 32 | 0 | 0 |
| | | RH | 216 | 268 | 270 | 228 | 142 | 78 | 36 | 20 | 7 |
| | | Mean | 180 | 236 | 256 | 213 | 140 | 79 | 34 | 10 | 3.5 |
| | Air volume Mean ($M^3$/min) | | 1.41 | 5.57 | 10.06 | 11.72 | 9.9 | 6.83 | 3.47 | 1.18 | 0.47 |
| | Motor 110 V, 53.6 W, 1435 rpm | | | | | | | Total Air Volume | | 50.6 | |
| With Filter Bed | Air Velocity (M/min) | LH | 140 | 230 | 225 | 195 | 120 | 58 | 14 | 0 | 0 |
| | | RH | 112 | 160 | 225 | 197 | 198 | 158 | 98 | 57 | 36 |
| | | Mean | 126 | 195 | 225 | 196 | 159 | 108 | 56 | 28.5 | 18 |
| | Air volume Mean ($M^3$/min) | | 0.99 | 4.62 | 8.84 | 10.78 | 11.24 | 9.33 | 5.71 | 3.36 | 2.41 |
| | Motor: 110 V, 54.8 W, 1330 rpm | | | | | | | Total Air Volume | | 57.27 | |
| Without Opening | Air Velocity (M/min) | LH | 215 | 250 | 212 | 155 | 72 | 34 | 0 | 0 | 0 |
| | | RH | 136 | 178 | 256 | 246 | 213 | 114 | 82 | 30 | 0 |
| | | Mean | 176 | 214 | 234 | 201 | 143 | 74 | 41 | 15 | 0 |
| | Air volume Mean ($M^3$/min) | | 1.38 | 5.05 | 9.2 | 11.03 | 10.07 | 6.39 | 4.18 | 1.77 | 0 |
| | Motor: 110 V, 53.7 W, 1395 rpm | | | | | | | Total Air Volume | | 49.07 | |

-continued

| Type | Measure Point | | 1 | 2 | 3 | 4 | 5 | 6 | 7 | 8 | 9 |
|---|---|---|---|---|---|---|---|---|---|---|---|
| | Measurements of Air Velocity & Air Volume (12"-fan) (Refer to FIG. 3) | | | | | | | | | | |
| With Enlarged Opening | Air Velocity (M/min) | LH | 122 | 198 | 184 | 128 | 96 | 54 | 24 | 0 | 0 |
| | | RH | 100 | 126 | 164 | 240 | 180 | 136 | 82 | 36 | 18 |
| | | Mean | 111 | 162 | 174 | 166 | 138 | 95 | 53 | 18 | 9 |
| | Air volume Mean($M^3$/mm) | | 0.87 | 3.82 | 6.84 | 9.13 | 9.76 | 8.21 | 5.41 | 2.12 | 1.21 |
| | Motor: 110 V, 48.9 W, 1511 rpm | | | | | | | Total Air Volume | | 47.36 | |

As measured, air volumes of the prior art of the fan blade at different rpm are respectively 50.60 $M^3$/min and 49.07 $M^3$/min, 55.67 $M^3$/min, of the fan blade with an opening; 47.36 $M^3$/min, of the fan blade with an enlarged opening; and 57.2 $M^3$/min, of the fan blade 1 having its central opening 11 covered up with the active carbon active carbon filter bed 2, i.e., the present invention.

Figure 3:
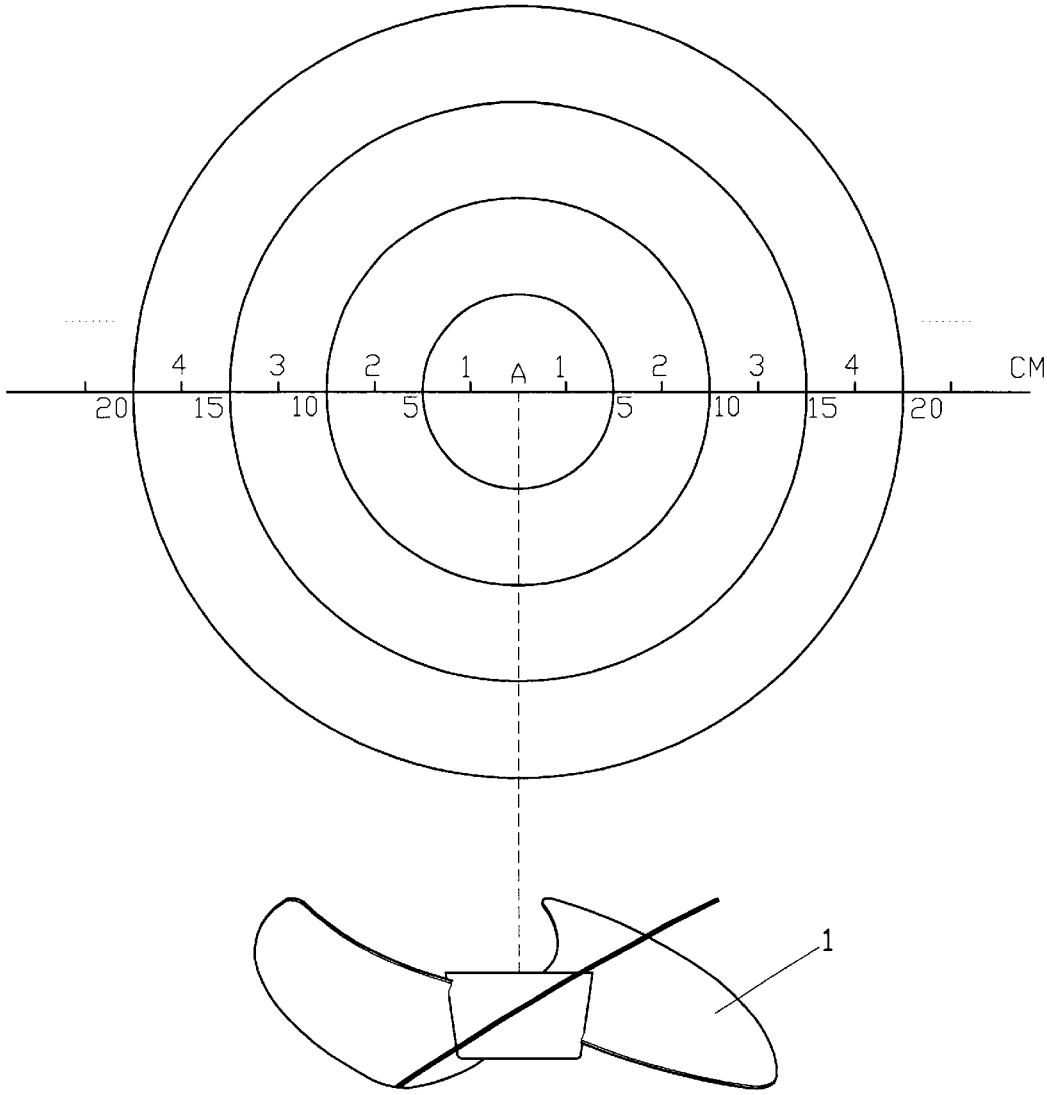
FIG. 3 is a schematic view of air velocity/volume measurement of the first preferred embodiment of the present invention.

Figures given in the table are availed from field tests done by the inventor. Taking the fan blade 1 in conjunction with the active carbon filter bed 2 of one of the preferred embodiments of the present invention is as an example. Referring to FIG. 3, the fan blade 1 to be tested is 3 meters away from the central point A with the radius of each concentric circle respectively 5 cm, 10 cm, 15 cm . . . , and nine test points are defined at LH and RH sides. Test Points 1~3 are calculated as follows:

(1) Test Point One

Air Volume=Area×Air Velocity $Q=\pi\gamma^2=3.1416\times0.05^2\times126=0.9896\approx0.99$ ($M^3$/min)

(2) Test Point Two $Q=3.1416\times(0.1^2-0.05^2)\times195=4.59459\approx4.60$ ($M^3$/min)

(3) Test Point One $Q=3.1416\times(0.15^2-0.1^2)\times225=8.83575\approx8.84$ ($M^3$/min)

and so on.

The total air volume is the sum of those measured at all nine test points. Therefore, air volume by type of the fan blade can be seen clearly from the Table. 57.27 $M^3$1 min, the air volume of the fan blade of the first preferred embodiment of the present invention is slightly than that of any of the other types of the fan blade. Proving that the fan blade 1 provided with the active carbon filter bed 2 will not affect the overall air blow function of the fan blade 1.

Figure 4:
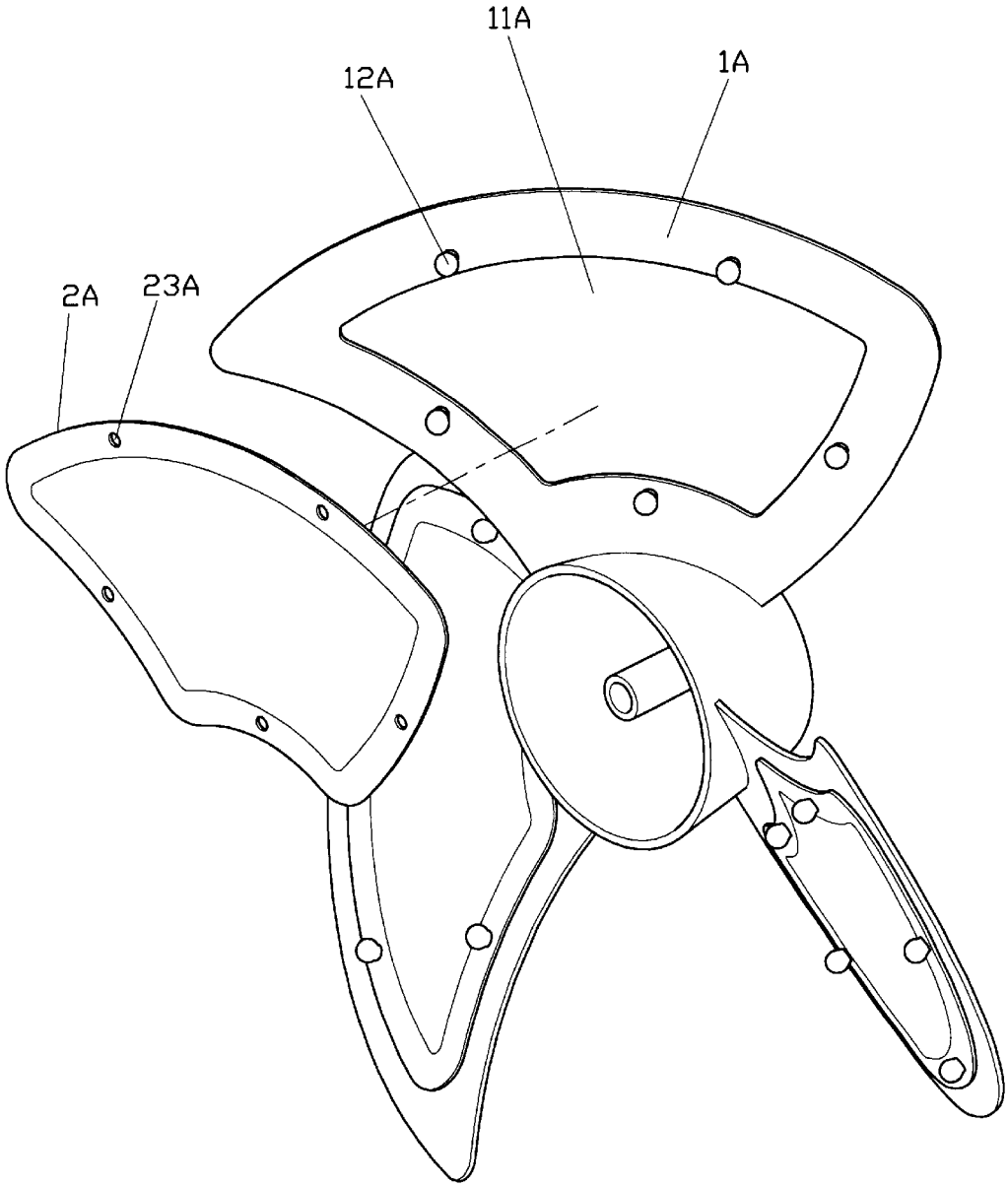
FIG. 4 is a perspective view of a second preferred embodiment of the present invention as assembled.

In addition to being adhered to the fan blade 1, the active carbon filter bed 2 can also be provided as illustrated in FIG. 4, showing the fixation of the second preferred embodiment of the present invention. A plurality of locking nips 12A are provided where appropriately on an external loop surface corresponding to the opening 11A of the fan blade 1A, and a plurality of holes 23A are provided on the active carbon filter bed 2A at where corresponding to the locking nips 12A so that the active carbon filter bed 2A can be fixed onto the fan blade 1A by buckling those preset holes 23A onto those locking nips 12A of the fan blade 1A. The second preferred embodiment allows an easy and quick replacement of the active carbon filter bed 2A.

Figure 5:
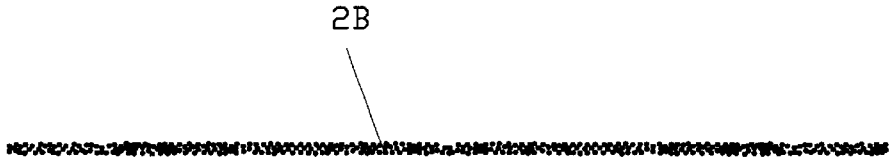
FIG. 5 is a sectional view of the active carbon filter bed of a third embodiment of the present invention.
Figure 6:
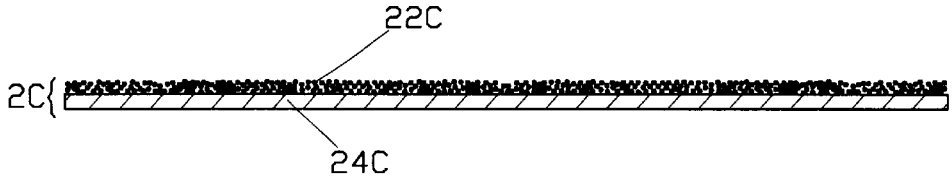
FIG. 6 is a sectional view of the active carbon filter bed of a fourth embodiment of the present invention.

FIGS. 5~8 show the various types of construction of the active carbon filter bed 2B, 2C, 2D and 2E, of the present invention. As illustrated in FIG. 5, the third preferred embodiment of the invention, the active carbon filter bed 2B is in a form of porous sheet produced by blending power, grain, or fiber active carbon and pulp. As illustrated in FIG. 6, the fourth preferred embodiment of the invention, the active carbon filter bed 2C has the active carbon bed 22C directly attached by adhering, spraying or any other means practical to either or both sides of a base filter element 24C comprised of non-woven fabric, fiber bed, porous bed of PE or PU foam, and said active carbon bed 22C can be powder or grain or filament.

Figure 7:
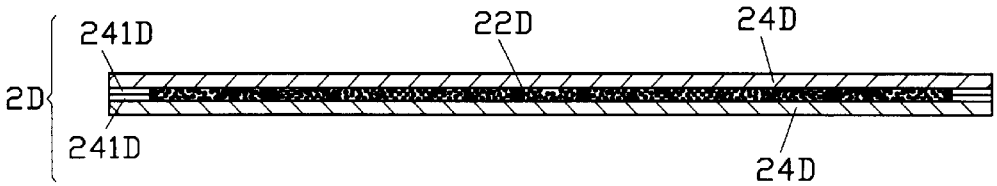
FIG. 7 is a sectional view of the active carbon filter bed of a fifth embodiment of the present invention.

As illustrated in FIG. 7, the fifth preferred embodiment of the invention, wherein the active carbon filter bed 2D is made of the active carbon bed 22D which can be in a form of powder, grain or staple or a whole sheet sandwiched between two layers of basic filter element 24D comprised of non-woven fabric, fiber bed, porous PE or PU foam, either by direct fusion (e.g. ultrasonic) binding, glue or any other means as illustrated. Three edges are directly attached leaving one edge fastened with adhesive bands 241D to allow replacement of the active carbon bed 22D or cleaning the base filter elements 24D.

Figure 8:
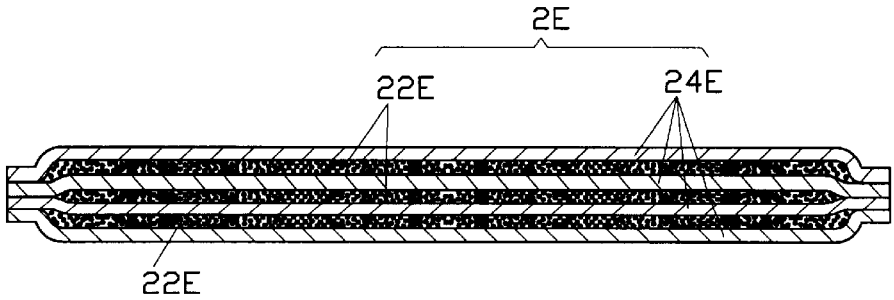
FIG. 8 is a sectional view of the active carbon filter bed of a sixth embodiment of the present invention.

As illustrated in FIG. 8, the sixth preferred embodiment of the invention, wherein the active carbon filter bed 2E is comprised of more than two base filter elements 24E and the active carbon bed 22E is sandwiched between two abutted layers of the base filter elements 24E in the same construction of the fifth preferred embodiment of the present invention.

All the preferred embodiments of the active carbon filter beds 2B, 2C, 2D and 2E of the present invention are also capable of confining the powder, grain, staple or a whole sheet of active carbon bed in the base filter elements 24C, 24D and 24E without causing the active carbon bed to escape into the air and pollute the room.

Figure 9:
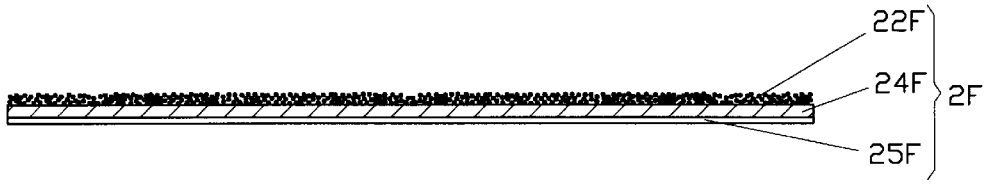
FIG. 9 is a sectional view of the active carbon filter bed of a seventh preferred embodiment of the present invention.
Figure 10:
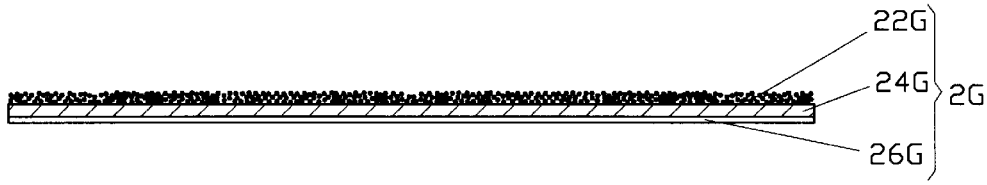
FIG. 10 is a sectional view of the active carbon filter bed of an eighth preferred embodiment of the present invention.
Figure 11:
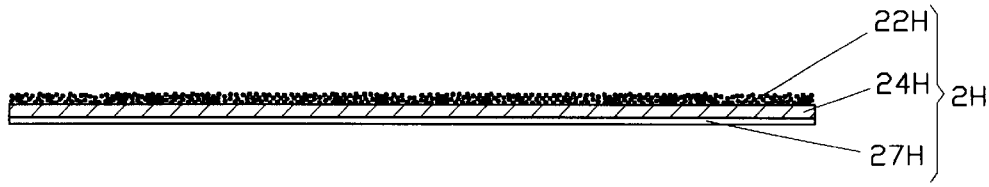
FIG. 11 is a sectional view of the active carbon filter bed of a ninth preferred embodiment of the present invention.

FIGS. 13~15 show the preferred embodiments of the adhesion bed of the present invention, and all said embodiments are based on the fourth preferred embodiment of the active carbon filter bed 2 illustrated in FIG. 6 (adapted to the other preferred embodiments). An adhesion glue 25F is separately provided on the back of the active carbon filter bed 2 as illustrated in FIG. 9, and said adhesion glue 25F may be in the form of adhesive band 26G which allows repeated use, as shown in FIG. 10; equi-directional magnet 27H in FIG. 11; or any other adhesion or construction.

I claim:

1. A fan blade provided with an active carbon filter bed, wherein, an opening is provided at a central portion of the fan blade passing between opposing sides thereof, at least one active carbon filter bed being attached to one side of the fan blade overlapping the opening.

2. A fan blade provided with an active carbon filter bed as claimed in claim 1, wherein, the active carbon filter bed is directly adhered to the fan blade.

3. A fan blade provided with an active carbon filter bed as claimed in claim 1, wherein, the active carbon filter bed is made a porous sheet of the mixture of powder, grain or fiber of active carbon and pulp.

4. A fan blade provided with an active carbon filter bed as claimed in claim 1, wherein, the active carbon filter bed includes at least two base filter elements with two abutted base filter elements sandwiching or adhered with the active carbon bed.

5. A fan blade provided with an active carbon filter bed as claimed in claim 1, wherein, an adhesion bed is separately provided on the back of the active carbon filter bed and comprises glue, adhesive band, equi-directional magnet or any other adhesion or construction that allows.

6. A fan blade provided with an active carbon filter bed, wherein an opening is provided in a center of the fan blade, and said openings is covered with an active carbon filter bed, wherein, said active carbon filter bed includes powder, grain or staple of active carbon attached onto a non-woven fabric, fiber bed, or staple of porous PE or PU base filter element.

7. A fan blade provided with an active carbon filter bed, as claimed in claim 6, wherein, the base filter element is disposed in the form of a web.

8. A fan blade provided with an active carbon filter bed, wherein an opening is provided in a center of the fan blade, and said opening is covered with an active carbon filter bed, wherein, an adhesive band is provided on at least one edge of at least one side of the fan blade, and adhesive band also being provided on the active carbon filter bed, the filter bed being fastened onto the fan blade by adjoining at least two of said adhesive bands.

* * * * *